United States Patent [19]

Ford et al.

[11] Patent Number: 4,514,199

[45] Date of Patent: Apr. 30, 1985

[54] VACUUM CLEANER DIRT BOX

[75] Inventors: Roger S. Ford, North Ridgeville; Herman J. Shie, III, Elyria, both of Ohio; Thomas E. Baird, Sr., Springfield, Ill.

[73] Assignee: The Scott & Fetzer Company, Cleveland, Ohio

[21] Appl. No.: 614,261

[22] Filed: May 25, 1984

[51] Int. Cl.[3] ..... B01D 50/00

[52] U.S. Cl. ..... 55/337; 15/349; 15/352; 15/353; 55/366; 55/375; 55/429; 55/433; 55/447; 55/464; 55/472; 55/473; 55/DIG. 3; 285/7

[58] Field of Search ..... 55/337, 366, 375, 429, 55/433, 472, 473, 447, 448, 450, 461, 464, DIG. 3; 15/349, 352, 353; 285/7, 334

[56] References Cited

U.S. PATENT DOCUMENTS

| | | | |
|---|---|---|---|
| 1,983,175 | 12/1934 | Kirby | 55/366 |
| 2,133,141 | 10/1938 | Holm-Hansen | 55/366 X |
| 2,537,523 | 1/1951 | Frost | 55/433 X |
| 2,583,054 | 1/1952 | Kirby | 15/352 X |
| 2,823,411 | 2/1958 | Kirby | 55/366 X |
| 3,468,563 | 9/1969 | Duret | 285/334 X |
| 3,608,333 | 9/1971 | Selley et al. | 15/352 X |
| 4,262,384 | 4/1981 | Bowers | 55/375 X |

*Primary Examiner*—Kathleen J. Prunner

*Attorney, Agent, or Firm*—Pearne, Gordon, Sessions, McCoy, Granger & Tilberry

[57] ABSTRACT

A dirt box for an upright vacuum cleaner comprises an elliptical upper side wall portion below a top wall, a bowl-shaped bottom wall, an inlet neck opening into the chamber in the lengthwise direction and below one end of the upper side wall portion, and aimed to establish a swirling action. An outlet port for the dirt box is off-center toward the end from which the inlet extends. The bowl-bottomed dirt box is tilted and emptied through the inlet neck.

5 Claims, 9 Drawing Figures

FIG. 6
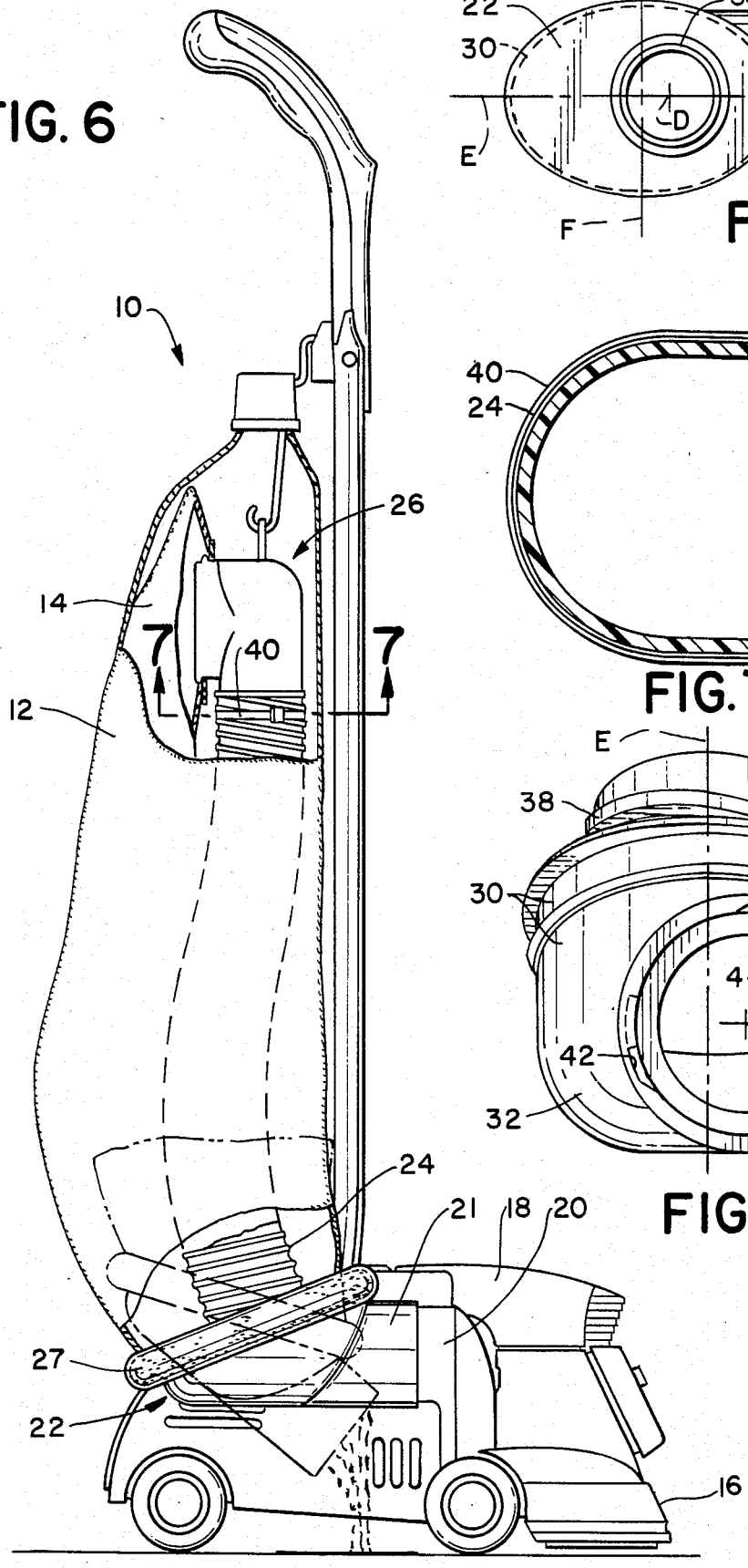
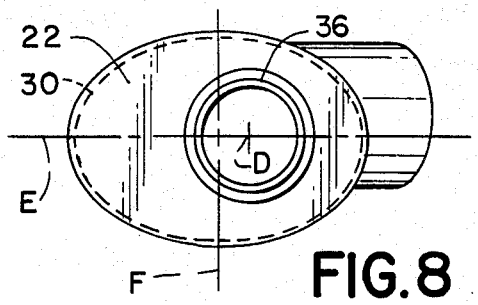
FIG. 8
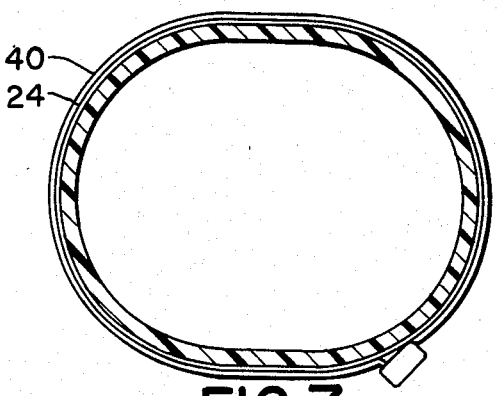
FIG. 7
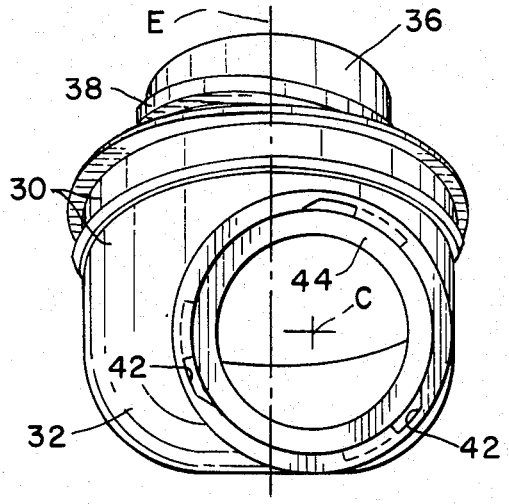
FIG. 5

VACUUM CLEANER DIRT BOX

BACKGROUND OF THE INVENTION

This invention relates to upright vacuum cleaners, and more particularly to dirt boxes used with such cleaners.

Upright vacuum cleaners with reusable fabric filter bags have long been provided with a dirt box at the lower or intake end of the fabric bag. Dirt-laden air from the vacuum fan flows more or less tangentially into the dirt box, and then upwardly through the dirt box and into the fabric bag. The exhaust of the dirt box may either communicate directly with the interior of the fabric bag, or it may communicate with a sleeve or "fill tube" within the fabric bag, which in turn leads to a disposable paper filter bag carried within the fabric bag. In either case, the dirt box acts as a separator to collect larger, heavier particles before they enter the dirt bag. Such particles must be cleaned out from time to time, and to this end the dirt box is provided with a removable bottom. The dirt box may also serve as a clean-out receptacle for receiving dirt from the reusable fabric bag when that bag has been relied on for primary filtering and requires cleaning out. Such a prior art upright vacuum cleaner is shown in U.S. Pat. No. 4,262,384 of common assignee.

Dirt boxes of the prior art have involved a relatively high degree of turbulence of the dirt-laden air during through-flow. This turbulence reduces air wattage and interferes with proper centrifugal action, thereby detracting from both the vacuuming and dirt-separating functions of the vacuum cleaner. Furthermore, the prior art dirt boxes have been relatively bulky and costly to manufacture.

In another aspect of upright cleaners of the prior art which use disposable bags, it has been a practice of the prior art to use helically ridged and grooved, flexible vinyl plastic tubing for the fill tube which leads from the dirt box to a fitting directly associated with the disposable paper bag, and to engage this tube over a threaded collar at the dirt box outlet and seal the two together with a surrounding tie clamp. The tie clamp involves an operation and an additional component which it is desirable to eliminate in order to reduce manufacturing costs, if such can be done without sacrificing the effectiveness and reliability of the seal.

SUMMARY OF THE INVENTION

The present invention provides a compact dirt box which has a superior centrifugal swirling action that minimizes turbulence and loss of air wattage. The dirt box comprises an elliptical upper side wall portion below a top wall, a bowl-shaped bottom wall, and an inlet neck opening through the bowl-shaped bottom wall into the chamber in the lengthwise direction and below one end of the upper side wall portion, and aimed to establish a swirling action. An outlet port for the dirt box is off-center toward the end from which the inlet extends. Instead of a removable bottom for the dirt box, the invention provides for removal of collected particles through the disconnected air intake of the dirt box when the box is periodically cleaned. The shape of the box as just described accomplishes the guiding of collected particles to the air intake when the dirt box is disconnected from the vacuum fan and tilted so as to drop the air intake below the main body of the box.

The present invention also provides a seal between the dirt box and fill tube without application or use of a tie clamp. Instead, the threads on the outlet collar associated with the dirt box are edged in a way that has been found to produce an effective and reliable seal.

The advantages and features of the invention will be more fully understood from the following description of a specific embodiment.

BRIEF DESCRIPTION OF THE DRAWINGS

In the drawings,

FIG. 5 is an end elevation of the dirt box.

FIG. 6 is a side elevation of the cleaner seen in FIG. 1, with the fabric bag partly broken away to show the fill tube and part of the paper filter bag.

FIG. 7 is a view taken on line 7—7 in FIG. 6.

FIG. 8 is a view taken along line 8—8 of FIG. 3.

DETAILED DESCRIPTION OF THE DRAWINGS

Figure 1:
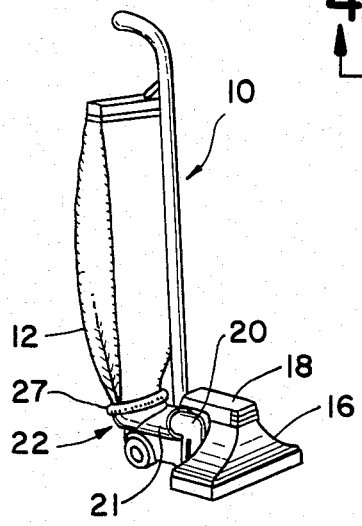
FIG. 1 is an isometric view of a vacuum cleaner using the dirt box of the invention.

Shown in FIGS. 1 and 6 is an upright vacuum cleaner 10 provided with a fabric filter bag 12 and a disposable paper filter bag 14. The cleaner includes a rug-cleaning nozzle 16, a motor housing 18 and an exhaust fan outlet 20. A vacuum cleaner fan (not shown) sucks dirt into the cleaner through the rug cleaning nozzle and then blows the dirt-laden air through the outlet tube 20 to the inlet neck 21 of a dirt box 22. The bottom end of the fabric bag 12 is attached to the top of the dirt box 22. The dirt box 22 will be more fully described below. As has been done with conventional dirt boxes, see for example U.S. Pat. No. 4,262,384 of common assignee, the dirt box of the present invention may exhaust into a fill tube 24 which is hung within the fabric bag 12 and feeds the dirt-laden air to the top end of the paper filter bag 14. The filter bag 14 is removable and replaceable in a known manner, as described for example in the aforesaid patent, a zipper (not shown) being provided at the rear side of the fabric bag 12 so that it may be opened and reclosed for such purposes. The fill tube 24 remains in place during removal and replacement of the paper bag. The fill tube is connected to the paper bag by a molded connector assembly 26. The details of such connection form no part of the present invention, but may be as described in the aforesaid patent.

As in the prior art, the dirt box is intended to act as a separator to collect larger, heavier particles before they enter the filter bags. The dirt box 22 of the invention, however, is of a novel design which eliminates a removable bottom and, instead, provides a bowl-like ovoid structure which has a superior centrifugal swirling action that minimizes turbulence and loss of air wattage. The dirt box can be readily emptied by being partially disconnected, tilted, and emptied through its intake.

Figure 2:
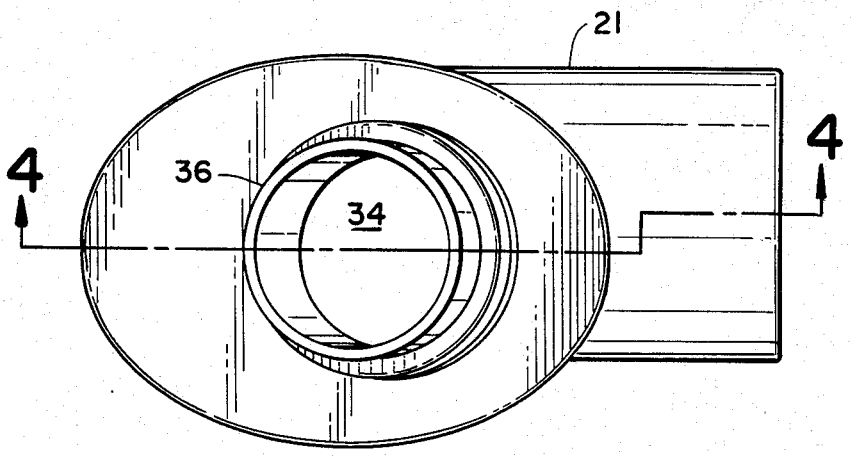
FIG. 2 is a plan view of the dirt box itself, taken on an enlarged scale.
Figure 4:
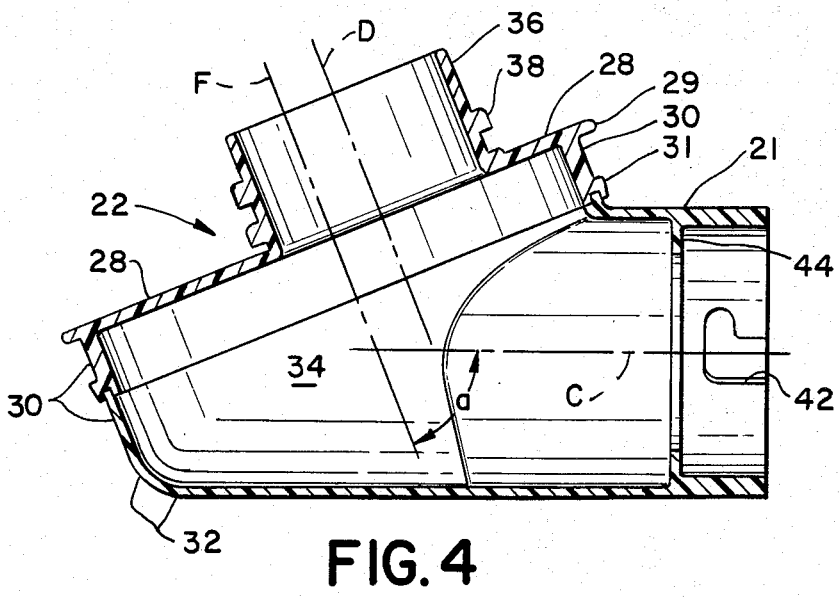
FIG. 4 is a cross section taken on line 4—4 of FIG. 2.

The dirt box includes a top wall 28 which slants downwardly in the lengthwise direction in the normal position of use of the box, such normal position being shown in solid lines in all of the figures. A side wall 30 is elliptical in shape where it is adjacent the top wall 28. The side wall 30 is faired into a permanently closed bottom wall 32 which generally has the shape of a somewhat elongated bowl. These walls define the dirt box chamber 34. The inlet neck 21 opens through the bowl-shaped bottom wall 32 into the dirt box chamber 34. As best seen from FIG. 2, such opening of the neck 21 through the bottom wall into the chamber 34 is in the lengthwise direction. As best seen in FIG. 4, such opening of the neck 21 into the chamber 34 is below the front end of the top wall 28 and is spaced downwardly from such end of the top wall by the elliptical portion of the side wall 30 which is adjacent the top wall 28.

Figure 3:
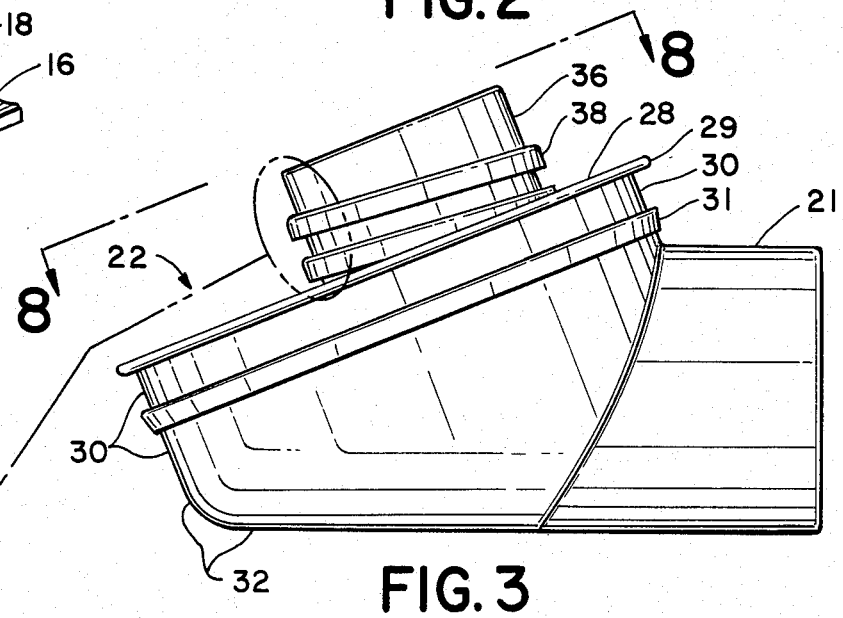
FIG. 3 is a side elevation of the dirt box.
Figure 3A:
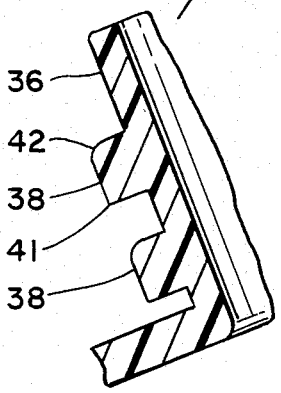
FIG. 3A is an enlarged fragmentary sectional view of a portion of FIG. 3.

The inlet neck 21 is aimed in a lengthwise direction, but as seen, for example, in FIG. 5, the center or central axis C of the inlet neck is aimed to one side of the center of chamber 34. As best seen in FIGS. 3–5, the center of the inlet neck is aimed convergently toward the downwardly slanting top wall 28.

An outlet port in the top wall 28 is defined by outlet collar 36. As seen, for example, in FIG. 8, the center or central axis D of the outlet port (such axis being seen on end as a point in FIG. 8) is longitudinally offset from the center of the top wall, such offsetting being toward the front end of the top wall.

As best seen in FIG. 4, the dirt box 22 is formed in two parts which are welded together after being molded separately. The collar 36, top wall 28, and the elliptical upper portion of side wall 30 which is adjacent the top wall all are molded as a unitary part provided around its bottom edge with a suitable bead 31 and groove to receive the upper edge of the other unitary molded part, the latter comprising the remaining portions of side wall 30, the bowl-shaped bottom wall 32, and the inlet neck 21.

The fabric bag is provided with the conventional elastic band (helical spring or elasticized cord, not seen) sewn into a hem around the bag mouth, and this may be stretched over a retaining flange 29 formed at the edge of the top wall 28, so that the bag mouth is engaged around the upper elliptical portion of side wall 30 in the groove-like channel between flange 29 and bead 31. A flexible elastomeric collar 27 (FIGS. 1 and 6) may be provided to engage over the flange 29 and bead 31 to cover the just-described joinder of the fabric bag and dirt box.

As best seen in FIG. 8, the elliptical shape of side wall 30 is divided into symmetrical lateral halves by the imaginary plane of symmetry E which passes through the long axis of the elliptical shape, and is divided into symmetrical front and back halves by the imaginary plane of symmetry F which passes through the short axis of the elliptical shape. The outlet port formed by outlet collar 36 is symmetrical with respect to the plane E, while the central axis D of the outlet port is offset forwardly of the plane F but generally parallel thereto. As best seen in FIG. 4, the central axis C of the inlet neck is not normal to plane F but, rather, forms an acute angle a therewith. As best seen in FIG. 5, the central axis C (seen on end as a point) is offset from the plane E, but is generally parallel thereto.

The fill tube 24 comprises a helically ridged and grooved, flexible vinyl tube whose bottom end engages the threading 38 on outlet collar 36 and whose top end engages threading (not seen) on molded connector assembly 26. As is conventional, the top end engagement is secured by a tie clamp 40 which accomplishes a seal of the tube 24 to the threading on the connector assembly 26. According to the present invention, however, no tie clamp is required for the bottom connection of the fill tube. Instead, the threading 38 is formed with a relatively rounded upper crest edge 42 (say 0.06 inch radius), but a sharp lower crest edge 41 (say, 0.01 inch radius or less). This arrangement has been found to provide an effective and reliable seal between the fill tube 24 and the outlet collar without use of any tie clamp at such connection, with resulting cost saving.

The exhaust fan outlet tube 20 is provided with the male portion of a bayonet connection, and suitable bayonet connector slots 42 are provided on the female connector side associated with the inlet neck 21. When the parts are connected, the male end of the exhaust fan outlet tube 20 may seal against an O-ring (not shown) which is seated against the flange stop 44.

When the parts are connected and the cleaner is running, air passes through the dirt box with a swirling motion and heavy objects are caught in the chamber and separated with relatively little turbulence of the passing air. When the chamber 34 is to be emptied, the inlet neck 21, together with the dirt box proper, is bodily twisted to release the bayonet connection between the inlet neck 21 and exhaust fan outlet tube 20. To accomplish this, it is not necessary to disconnect the dirt box from the fabric bag 12 nor from the fill tube 24. After the bayonet connection is released, the neck 21 is tilted downwardly along with the rest of the dirt box, as shown in phantom in FIG. 6, in which position the chamber 34 may be readily emptied. The bayonet connection is then re-established for subsequent operation of the cleaner.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In an upright vacuum cleaner having a blower and a blower outlet tube, a dirt-collecting box comprising a top wall which slants downwardly in the lengthwise direction in the normal position of use of the box, a side wall which is elliptical in shape where it is adjacent said top wall, a bowl-shaped permanently closed bottom wall, said walls defining a dirt box chamber, an inlet neck connected to said blower outlet tube and opening through said bowl-shaped bottom wall into the chamber in the lengthwise direction and spaced below one end of the top wall, said opening of the inlet neck into the chamber being spaced downwardly from said one end of the top wall by said elliptical portion of said side wall, the center of said inlet neck being aimed in a lengthwise direction but to one side of the center of the chamber and also being aimed convergently toward said downwardly slanting top wall, and a laterally centered outlet port in the top wall, the center of said outlet port being longitudinally offset from the center of the top wall toward the end thereof associated with said one end of the top wall whereby air passes through said dirt box with a swirling motion and heavy objects are caught within said chamber and separated with relatively little turbulence of the passing air, said chamber being emptyable by disconnection of said inlet neck from said blower outlet tube and downward tilting of said neck for emptying of said chamber therethrough.

2. A device as in claim 1, said one end of the top wall being the front end thereof.

3. An upright vacuum cleaner having the dirt box of claim 1, a threaded outlet collar on the outer side of said top wall at said outlet port, a fill tube comprising a helically ridged and grooved flexible plastic tube having one end engaging the threading of the collar along at least part of the length of the collar, said threading having a generally flat crest with a relatively sharp crest edge on the side of the thread that faces the dirt box and a relatively rounded crest edge on the opposite side of the thread, said tube sealing to said sharp edge in the absence of a clamp or cable tie.

4. A dirt-collecting box for an upright vacuum cleaner comprising a chamber having a top wall which slants downwardly from front to back in the normal position of use of the box, said chamber also having a side wall which is elliptical in shape where it is adjacent said top wall, said elliptical shape being divided into symmetrical lateral halves by a first imaginary plane of symmetry passing through the long axis of the elliptical shape and being divided into symmetrical front and back halves by a second imaginary plane of symmetry passing through the short axis of the elliptical shape, lower portions of said side wall fairing into a bowl forming a bottom wall for the chamber, an outlet port in the top wall, said outlet port being generally symmetrical with respect to said first imaginary plane of symmetry, the central axis of said outlet port being offset forwardly of said second imaginary plane of symmetry but generally parallel thereto, an inlet neck extending into said bowl from the front end thereof, the central axis of said inlet neck forming an acute angle with its own projection on said second plane, said last-named axis being offset from said first imaginary plane of symmetry but generally parallel thereto.

5. In an upright vacuum cleaner, a fill tube leading from the outlet of a dirt box to a connection to a disposable bag, said outlet including a threaded outlet collar at the outlet port of the dirt box, said fill tube comprising a helically ridged and grooved flexible plastic tube having one end engaging the threading of the collar along at least part of the length of the collar, said threading having a generally flat crest with a relatively sharp crest edge on the side of the thread that faces the dirt box and a relatively rounded crest edge on the opposite side of the thread, said tube sealing to said sharp edge in the absence of a clamp or cable tie.

* * * * *